US010899149B2

(12) United States Patent
Pérez Muñoz et al.

(10) Patent No.: US 10,899,149 B2
(45) Date of Patent: Jan. 26, 2021

(54) DEVICE FOR ARRANGING A PRINT HEAD IN A CERTAIN POSITION

(71) Applicant: Océ Holding B.V., Venlo (NL)

(72) Inventors: Juan C. Pérez Muñoz, Venlo (NL); Henricus J. A. Van De Sande, Venlo (NL); Hubertus W. G. In 'T Zandt, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 0 days.

(21) Appl. No.: 16/671,715

(22) Filed: Nov. 1, 2019

(65) Prior Publication Data

US 2020/0147985 A1 May 14, 2020

(30) Foreign Application Priority Data

Nov. 9, 2018 (EP) ..... 18205404.9

(51) Int. Cl.
*B41J 25/00* (2006.01)

(52) U.S. Cl.
CPC ..... *B41J 25/001* (2013.01)

(58) Field of Classification Search
CPC .. B41J 25/001; B41J 2202/14; B41J 2202/20; B41J 2/1752
See application file for complete search history.

(56) References Cited

U.S. PATENT DOCUMENTS

| | | | |
|---|---|---|---|
| 9,126,445 | B1 | 9/2015 | Spence et al. |
| 2010/0245477 | A1 | 9/2010 | Ohkubo et al. |
| 2012/0092403 | A1* | 4/2012 | Profaca ..... B41J 2/16508 347/14 |

FOREIGN PATENT DOCUMENTS

JP 2013-256077 A 12/2013

OTHER PUBLICATIONS

IP.com search (Year: 2020).*
European Search Report, issued in Application No. 18 20 5404, dated May 6, 2019.

* cited by examiner

*Primary Examiner* — Lisa Solomon
(74) *Attorney, Agent, or Firm* — Birch, Stewart, Kolasch & Birch, LLP

(57) ABSTRACT

A device for arranging a print head in a certain position includes a main unit including a main frame providing a primary abutting part and a support part; a sub-unit including a sub-frame providing a secondary abutting part, a connecting member movable relative to the sub-frame between a first position and a second position, and an urging member for urging the connecting member from the second position towards the first position, and a print head connectable to the connecting member to form a sub-assembly with the sub-unit. The main unit is configured to accommodate a sub-assembly formed by the sub-unit and the print head in a preliminary position in which, with the connecting member in the first position, the print head contacts the support part, and the secondary abutting part is spaced apart from the primary abutting part. The support part is configured to mate with the print head to prevent lateral displacement of the print head relative to the main frame, and the sub-frame is movable relative to the main frame from the preliminary position towards a final position against a force exerted onto the sub-frame by the urging member while the connecting member moves from the first position towards the second position against a force exerted onto the connecting member by the urging member, under the influence of a force exerted onto the print head by the support part, wherein in the final position, the secondary abutting part abuts the primary abutting part.

15 Claims, 5 Drawing Sheets

DEVICE FOR ARRANGING A PRINT HEAD IN A CERTAIN POSITION

FIELD OF THE INVENTION

The present invention relates to a device for arranging a print head in a certain position.

BACKGROUND ART

An inkjet printer comprises at least one print head having a nozzle face providing at least one array of jetting nozzles for jetting out ink droplets. In order to receive the ink droplets in a correct position on a print medium, the print head needs to be arranged in a certain position with the nozzle face oriented in parallel to a plane comprising a side of the print medium during printing.

A known device for arranging a print head in a certain position comprises a part for receiving a print head, arranged on a frame. A position of the part is adjustable relative to the frame, such that the print head can be aligned with the nozzle face in parallel to a certain plane via an adjustment of the position of the part relative to the frame.

Adjusting the position of a print head via an adjustment of a position of a receiving part relative to a frame has been found cumbersome, especially in the case of a device configured for holding a plurality of print heads, wherein a position of each print head needs to be set individually. In addition, every adjusting mechanism adds bulk to a device, which prevents the device from having a compact form.

The present invention aims to provide a device allowing a print head to be relatively easily arranged in a certain position, especially after a print head has been replaced. A further aim is to provide a device which can be made to be relatively compact.

SUMMARY OF THE INVENTION

According to an aspect of the invention, a device for arranging a print head in a certain position includes:

- a main unit comprising a main frame providing a primary abutting part and a support part;
- a sub-unit comprising a sub-frame providing a secondary abutting part, a connecting member movable relative to the sub-frame between a first position and a second position, and an urging member for urging the connecting member from the second position towards the first position, and
- a print head connectable to the connecting member to form a sub-assembly with the sub-unit, wherein the main unit is configured to accommodate a sub-assembly formed by the sub-unit and the print head in a preliminary position in which, with the connecting member in the first position, the print head contacts the support part, and the secondary abutting part is spaced apart from the primary abutting part, wherein the support part is configured to mate with the print head to prevent lateral displacement of the print head relative to the main frame, wherein the sub-frame is movable relative to the main frame from the preliminary position towards a final position against a force exerted onto the sub-frame by the urging member while the connecting member moves from the first position towards the second position against a force exerted onto the connecting member by the urging member, under the influence of a force exerted onto the print head by the support part, wherein in the final position, the secondary abutting part abuts the primary abutting part.

In a device as described, a print head held by the sub-unit contacts the support part when the sub-unit is first accommodated in a preliminary position on the main unit. Next, the sub-frame can be moved relative to the main frame such that the secondary abutting part is brought to abut the primary abutting part. During this motion, the print head, connected to the connecting member, is held in place relative to the main frame by the support part. Displacement of the sub-frame relative to the print head causes the connecting member to move relative to the sub-frame, which causes the urging member to elastically deform, and exert a force onto each of the sub-frame and the connecting member. The sub-frame is moved relative to the main frame against the force exerted onto the sub-frame by the urging member. The force exerted onto the print head via the connecting member by the urging member causes the support part to firmly mate with the print head, which assures that the support part at least in the final position of the sub-frame relative to the main frame prevents in-plane displacement of the print head relative to the main frame, resulting in the print head being securely positioned.

In an embodiment, the main unit is configured to hold a sub-assembly of the sub-unit and the print head with the nozzle face of the print head oriented in parallel to a plane defined by two orthogonal axes, wherein the sub-unit is configured to move from the preliminary position towards the final position by a translation along an axis normal to said plane. This allows for an easy way of accommodating a sub-assembly on the main unit, wherein the print head is moved to first contact and then be pressed onto the support part via a single motion.

In an embodiment, the main unit and the sub-unit comprise aligning elements configured to cooperate with each other to align an assembly of the sub-unit and the print-head relative to the main unit such that a mating part of the print head is positioned in line with a mating part of the support part. This assures that a sub-assembly of the sub-unit and the print head is correctly positioned in the preliminary position in order for the print head to mate with the support part.

In an embodiment, the connecting member is movable relative from the first position towards the second position along a certain axis, wherein the connecting member is flexible to allow for certain motion of the print head relative to the sub-frame in a plane normal to said axis. This allows for the print head to find its position relative to the main frame by mating with the support part in a way that requires sideways motion of the print head.

In an embodiment, the connecting member comprises a rod guided to move relative to the sub-frame along its longitudinal axis.

The urging member may then comprise a helical spring coaxially arranged around the rod.

In an embodiment, the sub-frame carries a further connecting member connectable to the support part, wherein the sub-frame comprises a further urging member for exerting a force onto the sub-frame and/or the support part via the further connecting member. Then, a force exerted onto the sub-frame and/or the support part by the first urging member via the first connecting member can be compensated for by a force exerted onto the sub-frame and/or the support part by the further urging member via the further connecting member, in order to limit deformation of especially the support part, and hence assure that a print head is supported in the right position.

In an embodiment, the device comprises a first support part and an adjacent second support part configured to collectively support the print head, wherein the pair of support parts provides a plurality of mating parts for mating with certain parts of the print head.

The print head may have three mating parts, wherein the pair of support parts provides three mating parts for mating with the mating parts of the print head.

The mating parts of the print head may comprise ball parts, wherein the mating parts of the pair of support parts comprise a flat surface, a conical recess and a vee-groove recess.

In an embodiment, the primary abutting part and the secondary abutting part are configured to be attached to each other. This assures that the sub-frame is securely kept in the final position.

In an embodiment, the sub-unit is configured to hold an array of print heads, wherein each print head is connectable to the sub-frame via a respective connecting member.

In an embodiment, the main unit is configured to accommodate an array of sub-units.

BRIEF DESCRIPTION OF THE DRAWINGS

Other objects, features, and advantages of the present invention will become more apparent from the following detailed description when read in conjunction with the accompanying drawings, in which.

DETAILED DESCRIPTION OF THE DRAWINGS

Figure 1:
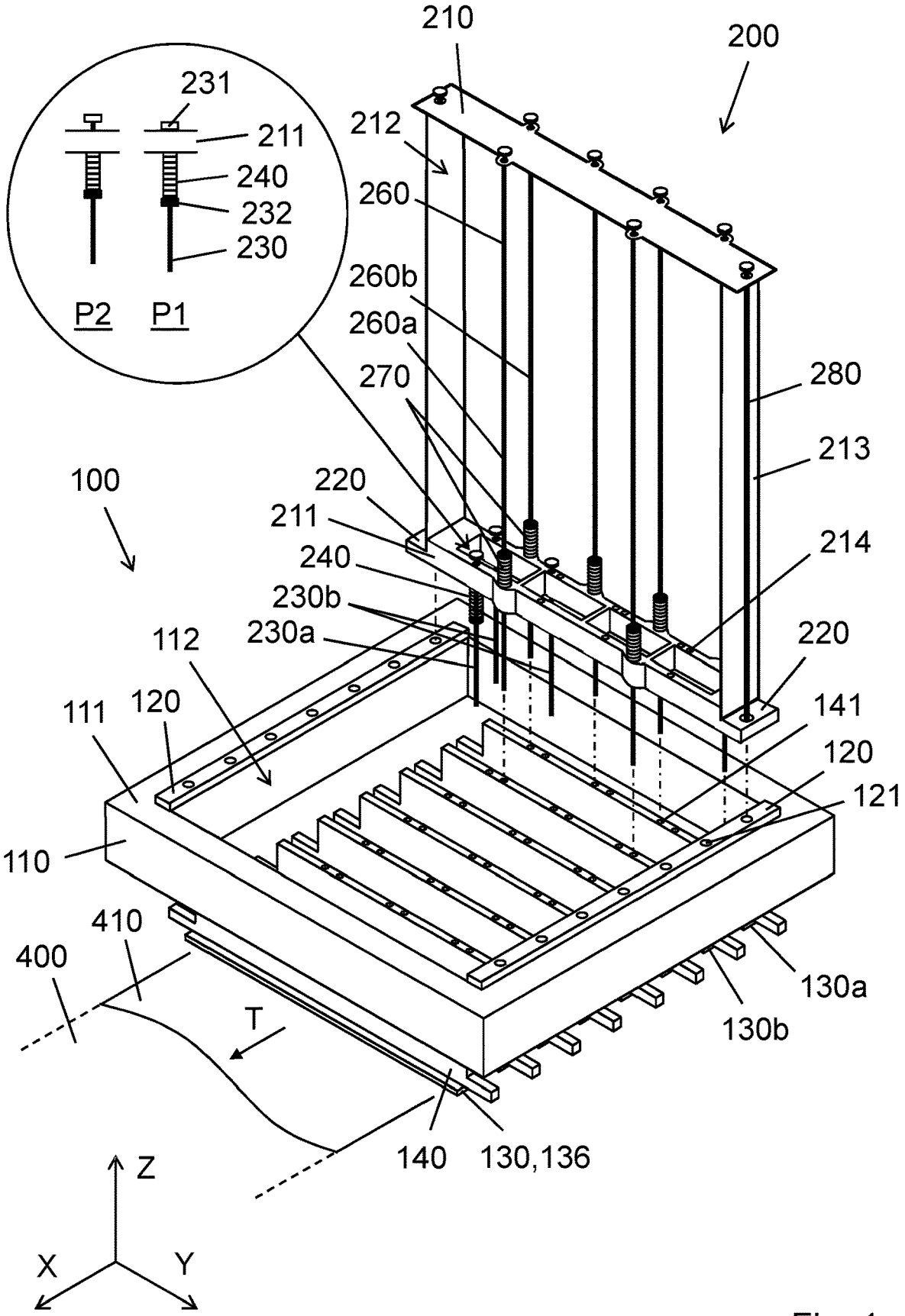
FIG. 1 is a perspective view of the main unit and a sub-unit of a device according to a first embodiment of the invention in a schematic representation.

FIG. 1 shows a device 100, 200 for arranging an inkjet print head in a certain position relative to a transport path 400 for transporting a print medium 410 through a printer.

The transport path 400 is configured for transporting a print medium 410 in a transport direction T past the device 100, 200 with the print medium 410 oriented in parallel to a plane defined by two mutually orthogonal main axes X, Y of the device 100, 200. In the shown embodiment, the two main axes X, Y are both horizontal, and the transport direction T in the shown embodiment extends in parallel to a first main axis X.

The device 100, 200 includes a main unit 100 for accommodating at least one sub-unit 200 for holding a print head, and at least one such a sub-unit 200, to be accommodated by the main unit 100.

The main unit 100 is to remain fixed in a printer in an appropriate position relative to the transport path 400, while the sub-unit 200 is to be detachably mounted on the main unit 100. Detachable mounting of the sub-unit 200 allows the sub-unit 200 to be replaced when necessary, and also facilitates temporary removal of the print unit 200 to enable replacement of a print head held by the sub-unit 200.

The main unit 100 shown is configured to accommodate a plurality of sub-units 200. The total number of sub-units 200 to be accommodated will typically relate to the number of inks or other printing substances, such as primers, that are to be used in a printer comprising the device 100, 200. Each sub-unit 200 will then be assigned to solely hold print heads for printing with a specific one of the different printing substances.

The main unit 100 is configured to accommodate the plurality of sub-units 200 arranged in an array along the first main axis X.

The sub-unit 200 shown is configured to hold a plurality of print heads arranged in an array along the second main axis Y, such that the plurality of print heads, or at least an assembled nozzle array comprising the nozzle arrays of each individual print head, will extend across a width of the print medium 410 transported along the transport path 400.

The main unit 100 comprises a main frame 110 providing two primary abutting parts 120 and a plurality of support parts 130, 130*a*, 130*b*.

In the shown embodiment, the main frame 110 comprises a substantially horizontally oriented main part 111 surrounding a receiving space 112 for receiving the pluralities of print heads held by the different sub-units 200 to be accommodated by the main unit 100. The main part 111 may comprise a relatively inaccurately shaped part, such as a part comprising bent sheet metal.

The primary abutting parts 120 are mounted on the main part 111 on opposite sides of the receiving space 112 with respect to the second main axis Y. Each primary abutting part 120 comprises a bar extending along the first main axis X, provided with an array of mounting holes 121 arranged along its length. Each primary abutting part 120 may comprise a relatively accurately shaped part, such as a milled part.

Figure 3A:
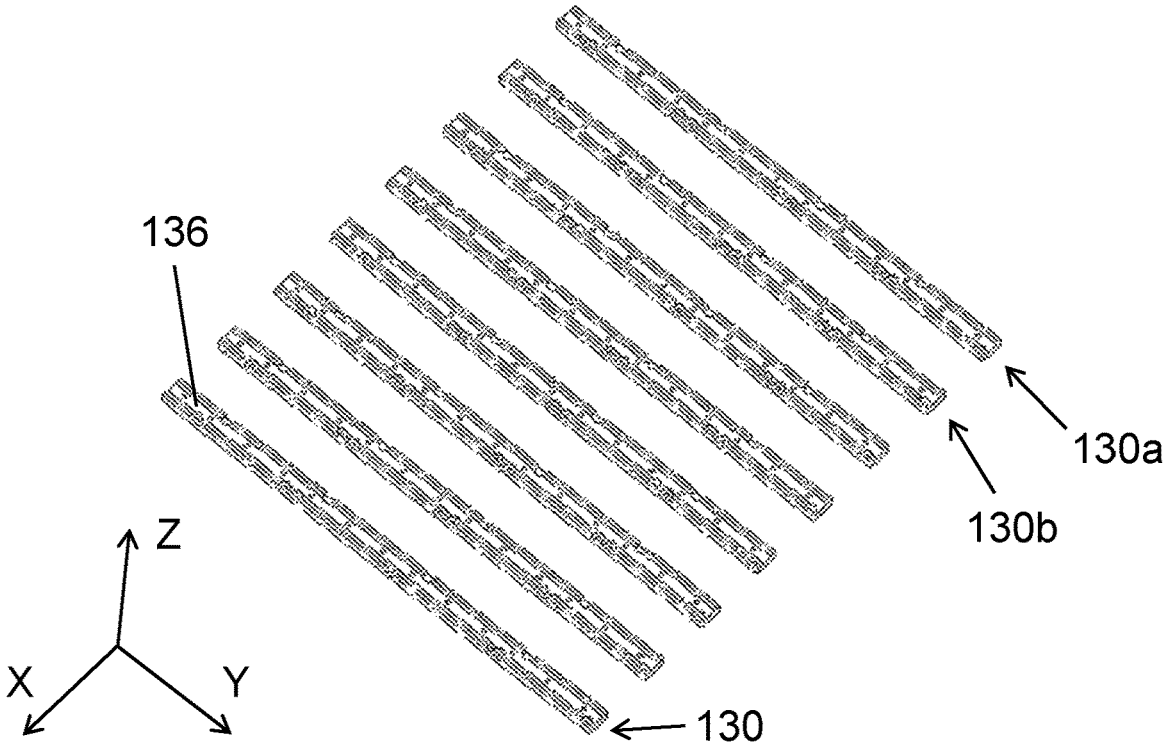
FIG. 3*a* is a perspective view of a plurality of support parts of the main unit of FIG. 1 according to a second embodiment of the invention.

Referring also to FIG. 3*a*, each support part 130, 130*a*, 130*b* comprises a bar 136 extending along the second main axis Y, wherein the different support parts 130, 130*a*, 130*b* are arranged to form an array extending along the first main axis X, with the plurality of support parts 130, 130*a*, 130*b* arranged below the receiving space 112. Each support part 130, 130*a*, 130*b*, like each primary abutting part 120, may comprise a relatively accurately shaped part, such as a milled part.

The sub-unit 200 comprises a sub-frame 210 providing two secondary abutting parts 220, a plurality of connecting members 230*a*, 230*b* each movable relative to the sub-frame 210 between a first position P1 and a second position P2, and a plurality of urging members 240, each for urging a respective connecting member 230*a*, 230*b* from the second position P2 towards the first position P1.

In the shown embodiment, the sub-frame 210 comprises an elongated main part 211, arranged to extend along the second main axis Y when the sub-unit 200 is aligned to be accommodated by the main unit 100.

The main part 211 serves as a carrier of the connecting members 230*a*, 230*b* and of a further frame part 213 extending towards a top end of the sub-unit 200, which encloses a space 212 for accommodating one or more parts for feeding towards or receiving back from a print head held by the sub-unit 200 certain fluids or electronic signals. With the sub-unit 200 aligned to be accommodated by the main unit 100, the further frame part 213 extends mainly along the second main axis Y and a third main axis Z normal to both the first main axis X and the second main axis Y, such that the sub-unit 200 as a whole has a relatively small dimension along first main axis X.

The secondary abutting parts 220 are formed as flanges extending from the main part 211 at opposite ends thereof, oriented in parallel to a plane defined by the first main axis X and the second main axis Y. Each secondary abutting part 220 passes an attachment rod 280 for attaching the sub-unit 200 to the main unit 100, each protruding from a respective secondary abutting part 220 at a bottom side, and extending in parallel to the further frame part 213 towards a top end of the sub-unit 200 along the third main axis Z.

In the shown embodiment, the sub-unit 200 comprises a plurality of three connecting members 230*a*, 230*b* for each print head to be held by the sub-unit 200.

In the shown embodiment, each plurality of three connecting members 230*a*, 230*b* comprises one connecting member 230*a* to be connected to a print head on one side of the print head, and a pair of connecting members 230*b* to be connected to a print head on an opposite side of the print head. To that end, the one connecting member 230*a* and the pair of connecting members 230*b* are spaced apart along the first main axis X.

In the shown embodiment, each connecting member 230*a*, 230*b* comprises a rod 230 oriented along the third main axis Z, guided to move along said main axis Z relative to the main part 211 of the sub-frame 210 by extending through a respective channel 214 provided in the main part 211. It is noted that the rod 230 has certain flexibility with regard to bending about each of the first main axis X and the second main axis Y.

Each connecting member 230*a*, 230*b* has an abutting part 231 associated with the respective rod 230, to abut against the main part 211 of the sub-frame 210 so as to define a relatively low first position P1 of the connecting member 230*a*, 230*b* relative to the sub-frame 210.

Each connecting member 230*a*, 230*b* further has associated therewith an urging member 240.

From the first position P1, each connecting member 230*a*, 230*b* is movable to a higher position P2 against a force exerted onto the connecting member 230*a*, 230*b* by the urging member 240, in which position P2 the abutting part 231 is spaced apart from the main part 211 of the sub-frame 210.

In the shown embodiment, each urging member 240 comprises a helical spring coaxially arranged around the rod 230 of a respective connecting member 230*a*, 230*b*, abutting with one end against the main part 211 of the sub-frame 210, and with another end against a part 232 arranged on the rod 230.

The sub-unit 200 further comprises a plurality of further connecting members 260*a*, 260*b*, also comprising certain connecting members 260*a* spaced apart from other connecting members 260*b* along the first main axis X.

In the shown embodiment, like each connecting member 230*a*, 230*b* for connecting to a print head, each further connecting member 260*a*, 260*b* comprises a rod 260 oriented along the third main axis Z and extending through a respective channel 214 provided in the main part 211, having certain flexibility with regard to bending about each of the first main axis X and the second main axis Y.

Unlike the connecting members 230*a*, 230*b* for connecting to a print head, however, each further connecting member 260*a*, 260*b* extends all the way towards the top end of the sub-unit 200, allowing the further connecting member 260*a*, 260*b* to be operated from said top end.

Like the connecting members 230*a*, 230*b* for connecting to a print head, the further connecting members 260*a*, 260*b* each have associated therewith an urging member 270 in the form of a helical spring coaxially arranged around the rod 260 of a respective further connecting member 260*a*, 260*b*, abutting with one end against the main part 211 of the sub-frame 210, and with another end against a part arranged on the rod 260.

The urging members 270 associated with the further connecting members 260*a*, 260*b* are positioned on an opposite side of the main part 211 of the sub-frame 210 with respect to the urging members 240 associated with the connecting members 240 for connecting to a print head, in order to act on the main part 211 from different sides.

The main unit 100 further comprises a plurality of stiffening bars 140 each carrying a support part 130, wherein each stiffening bar 140 is provided with a number of holes 141 allowing it to be connected to certain further connecting members 260*a*, 260*b*, by a threaded connection.

Figure 2:
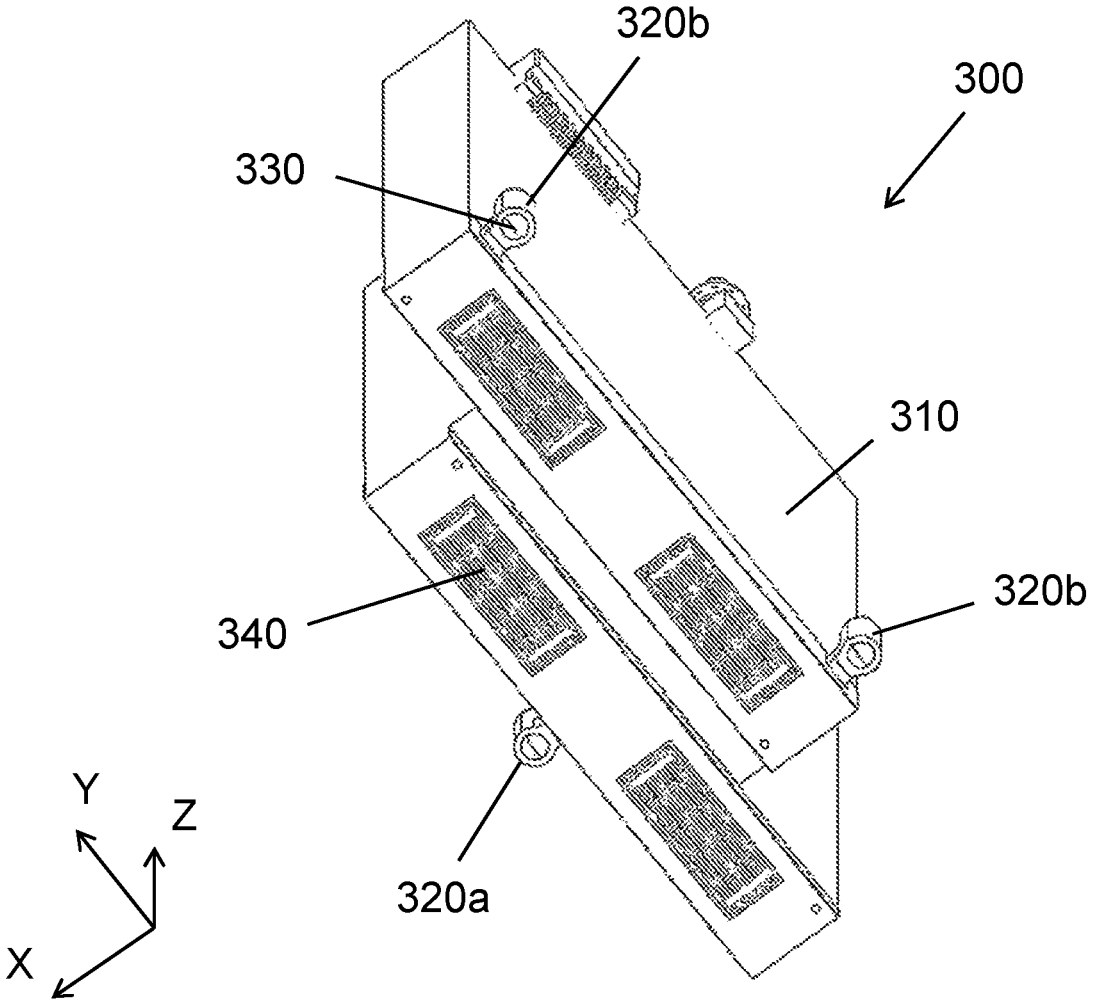
FIG. 2 is a perspective view of the print head suitable for use in combination with a device according to the invention.

FIG. 2 shows a print head 300 suitable to be held by the sub-unit 200 of FIG. 1.

The print head 300 is connectable to each one of three connecting members 230*a*, 230*b* as described via a respective one of three supporting feet 320*a*, 320*b* of the print head 300, protruding from a main body 310 of the print head 300 along the first main axis X.

For connecting to one connecting member 230*a* as described, one supporting foot 320*a* is arranged on one side of the main body 310. For connecting to a pair of connecting members 230*b* as described, a pair of supporting feet 320*b* is arranged on an opposite side of the main body 310.

Each supporting foot 320*a*, 320*b* comprises on a bottom side a ball part 330 to be supported by one of the support parts 130, 130*a*, 130*b* of the main unit 100, while each supporting foot 320*a*, 320*b* comprises on a top side a means for connecting to an end of a respective connecting member 230*a*, 230*b*, such as a threaded hole for receiving a threaded end of a connecting member 230*a*, 230*b*.

Figure 3B:
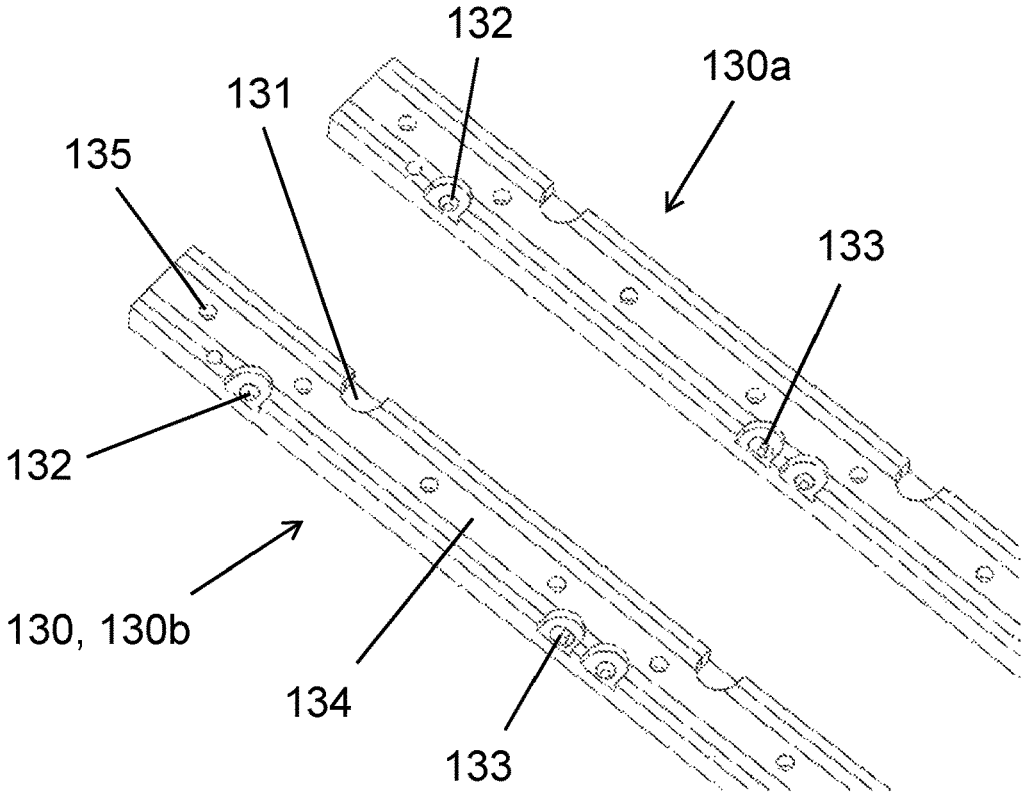
FIG. 3*b* shows a detail of the plurality of support parts of FIG. 3*a;*

FIG. 3*b* shows a detail of the plurality of support parts 130, 130*a*, 130*b* of the main unit 100 according to the embodiment of the invention as shown in FIG. 3*a*.

The support parts 130, 130*a*, 130*b* are arranged such that a first support part 130*a* and an adjacent second support part 130*b* in the array of support parts 130, 130*a*, 130*b* are configured to collectively support each print head 300 held by a certain sub-unit 200. To the end, each pair 130*a*, 130*b* of a first support part 130*a* and a second support part 130*b* provides mating parts 131, 132, 133 for mating with the ball parts 330 of a print head 300 on both the first support part 130*a* and the second support part 130*b*.

In the shown embodiment, the mating parts 131, 132, 133 for mating with the ball parts 330 of a print head 300 comprise a flat surface 131 for mating with the ball part 330 of the one supporting foot 320*a* of the print head 300, arranged on one support part 130*b*, and a conical recess 132 and a vee-groove recess 133 for mating with the pair of supporting feet 320*b* of the print head 300, arranged on another support part 130*a*.

With the different support parts 130, 130*a*, 130*b* held in parallel to a plane defined by the first main axis X and the second main axis Y, as well as in a fixed orientation with respect to a rotation about the third main axis Z, each three mating parts 131, 132, 133 define a position of a print head 300 in which the nozzle face 340 of the print head 300 is oriented in parallel to the plane defined by the first main axis X and the second main axis Y, and in a fixed orientation with respect to a rotation about the third main axis Z.

In the shown embodiment, each support part 130, 130*a*, 130*b* comprises mating parts 131, 132, 133 on opposite sides of a middle section 134 via which the support part 130, 130*a*, 130*b* is attached to a respective stiffening bar 140. To allow such attachment, each middle section 134 is provided with an array of holes 135 for receiving a set of screws.

Figure 4:
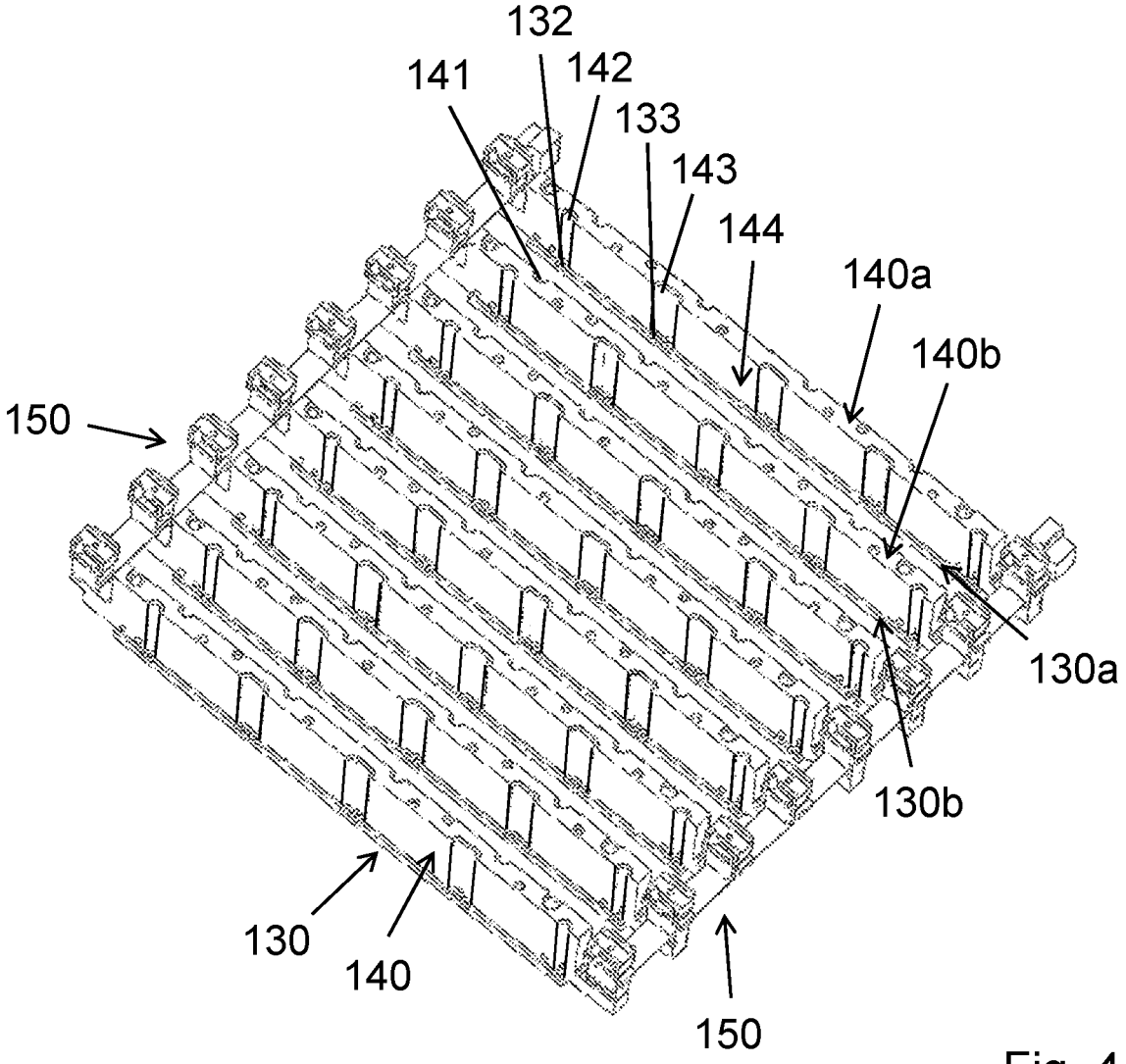
FIG. 4 is a perspective view of a sub-assembly of the main unit of FIG. 1 according to a third embodiment of the invention, comprising the plurality of support parts of FIG. 3*a;*

FIG. 4 shows a third embodiment of a sub-assembly 130, 140, 150 forming part of the main unit 100, comprising the plurality of support parts 130 of FIG. 3*a*, a plurality of stiffening bars 140, each carrying a respective support part 130, and two leaf spring assemblies 150 each at one side interconnecting the ends of the different stiffening bars 140 and flexibly attaching the ends to the main part 111 of the main frame 110 to allow for thermal expansion of the stiffening bars 140 and the support parts 130 relative to said main part 111.

In the embodiment shown, a pair of stiffening bars 140*a*, 140*b* carrying a pair of support parts 130*a*, 130*b* for supporting the print heads 300 held by a certain sub-unit 200 is spaced apart such as to have an intermediate space 144 for receiving at least the bottom ends of the respective print heads 300.

A side of each stiffening bar 140*a*, 140*b* facing the intermediate space 144 is provided with a recess 141, 142, 143 for receiving a respective foot 320*a*, 320*b* of a print head 300, at each location of a mating part 132, 133, for mating with the ball part 330 of a respective foot 320*a*, 320*b*, on the support part 130*a*, 130*b*. The recesses 141, 142, 143 aid to guide the feet 320*a*, 320*b* during insertion of a print head 300 in the intermediate space 144, such that each ball part 330 is brought to mate with a respective mating part 131, 132, 133.

Figure 5A:
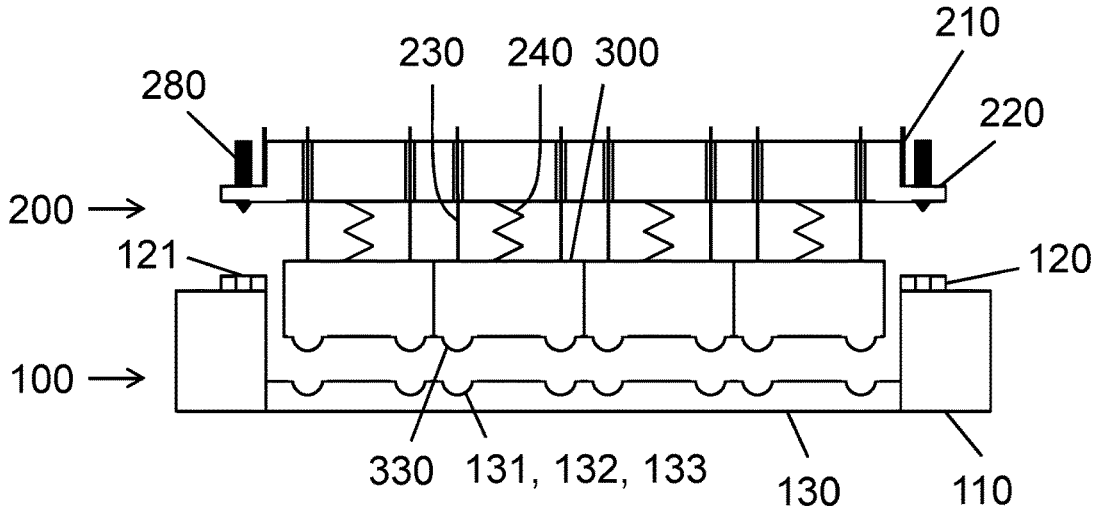
FIGS. 5*a* to 5*c* are cross-sectional views of the main unit and a sub-assembly formed by a sub-unit and a plurality of print heads according to a fourth embodiment of the present invention in different mutual positions of the main unit and the sub-unit, again in a schematic representation.
Figure 5B:
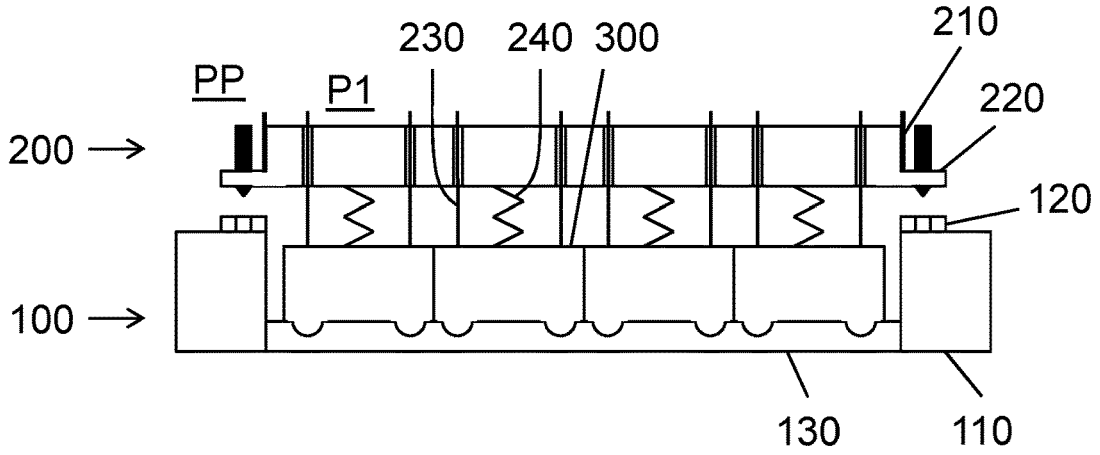
Figure 5C:
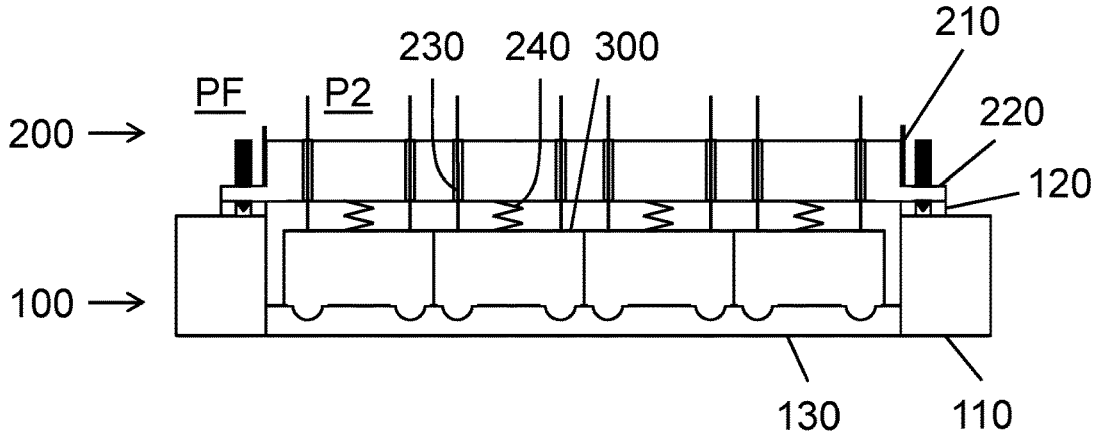

Referring to FIGS. 5*a* to 5*c*, during assembly of the main unit 100 with a sub-unit 200 holding a plurality of print heads 300, first, the sub-unit 200 is arranged with the ball parts 330 of each print head 300 each positioned over a mating part 131, 132, 133 of a respective support part 130. Next, the sub-unit 200 is moved to lower the print heads 300 onto the support part 130, wherein the ball parts 330 are brought to mate with the mating parts 131, 132, 133 in a preliminary position PP of the sub-frame 210 relative to the main frame 110. Finally, the sub-frame 210 is moved further, such that each abutting part 220 of the sub-frame 210 is brought to abut an abutting part 120 of the main frame 110 in a final position PF of the sub-frame 210 relative to the main frame 110.

With the sub-frame 210 in the final position, the attachment rods 280 are operated to be screwed inside a mounting hole 121 of an abutting member 120 of the main unit 100, so that the sub-unit 200 can be kept in the final position.

In addition, the further connecting members 260*a*, 260*b* are operated to be screwed into respective stiffening bars 140*a*, 140*b* carrying the support parts 130*a*, 130*b* supporting the print heads 300. By this operation, the further urging members 270 are elastically deformed to induce forces to be exerted by each further urging member 270 onto each of the sub-frame 210, by a respective further urging member 270 abutting against said sub-frame 210, and a respective support part 130*a*, 130*b*, via the further connecting member 260*a*, 260*b* and a connected stiffening bar 140*a*, 140*b*. Said forces compensate for the forces induced in the urging members 240 associated with each of the print heads 300 during motion of the sub-frame 210 from the preliminary position PP to the final position PF, so that in the assembled condition of the main unit 100 with the sub-unit 200, the support parts 130*a*, 130*b* are kept in a minimally deformed shape, aided also by the added stiffness of the stiffening members 140*a*, 140*b*, to assure a correct position of the print heads 300.

It is noted that FIGS. 5*a* to 5*c* show the urging members 240 associated with the connecting members 230 for connecting to a print head 300 merely as acting in between the sub-frame 210 and a print head 300. This is to indicate that according to the invention, merely a compliant connection is required between a print head 300 and the sub-frame 210, configured to induce forces acting onto both the print head 300 and the sub-frame 210 when a compliant part 240 is deformed by a relative displacement of the sub-frame 210 and the print head 300. Said forces assure firm mating between the print head 300 and a support part 130, as described earlier.

Any compliance in a direction normal to the direction in which the print head 300 approaches a support part 130, which in this example is provided by the flexibility of the connecting members 230, aids the mating process between the print head 300 and the support part 130, as also described.

The combination provides that a print head 300 is in an accurately defined position in an assembly of the main unit 100 with a sub-unit 200, whereas in an unmounted sub-unit 200, a print head 300 merely needs to be securely connected to the sub-frame 210, regardless of its position relative to the sub-frame 210 or other print heads 300.

It is to be understood that the disclosed embodiments are merely exemplary of the invention, which can be embodied in various forms. Specific structural and functional details are not to be interpreted as limiting, but merely as a basis for the claims and as a teaching for one skilled in the art to variously employ the present invention in virtually any appropriately detailed structure. In particular, features presented and described in separate dependent claims may be applied in combination, and any advantageous combination of such claims is herewith disclosed.

It is especially noted that the connecting member may comprise a flexible part, wherein at least an end of said part, connectable to the print head, is movable relative to the sub-frame between a first position and a second position.

It is also noted that the connecting member and the urging member may be integrated to form a single part.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A device for arranging a print head in a certain position, including:

a main unit comprising a main frame providing a primary abutting part and a support part;

a sub-unit comprising a sub-frame providing a secondary abutting part, a connecting member movable relative to the sub-frame between a first position and a second position, and an urging member for urging the connecting member from the second position towards the first position; and a print head connectable to the connecting member to form a sub-assembly with the sub-unit, wherein the main unit is configured to accommodate a sub-assembly formed by the sub-unit and the print head in a preliminary position in which, with the connecting member in the first position, the print head contacts the support part, and the secondary abutting part is spaced apart from the primary abutting part, wherein the support part is configured to mate with the print head to prevent lateral displacement of the print head relative to the main frame, wherein the sub-frame is movable relative to the main frame from the preliminary position towards a final position against a force exerted onto the sub-frame by the urging member while the connecting member moves from the first position towards the second position against a force exerted onto the connecting member by the urging member, under the influence of a force exerted onto the print head by the support part, and wherein in the final position, the secondary abutting part abuts the primary abutting part.

2. The device according to claim 1, wherein the main unit is configured to hold a sub-assembly of the sub-unit and the print head with the nozzle face of the print head oriented in parallel to a plane defined by two orthogonal axes, and wherein the sub-unit is configured to move from the preliminary position towards the final position by a translation along an axis normal to said plane.

3. The device according to claim 1, wherein the main unit and the sub-unit comprise aligning elements configured to cooperate with each other to align an assembly of the sub-unit and the print head relative to the main unit such that a mating part of the print head is positioned in line with a mating part of the support part.

4. The device according to claim 1, wherein the connecting member is movable from the first position towards the second position along a certain axis, and wherein the connecting member is flexible to allow for certain motion of the print head relative to the sub-frame in a plane normal to said axis.

5. The device according to claim 1, wherein the connecting member comprises a rod guided to move relative to the sub-frame along a longitudinal axis thereof.

6. The device according to claim 5, wherein the urging member comprises a helical spring coaxially arranged around the rod.

7. The device according to claim 1, wherein the sub-frame carries a further connecting member connectable to the support part, and wherein the sub-frame comprises a further urging member for exerting a force onto the sub-frame and/or the support part via the further connecting member.

8. The device according to claim 1, further comprising a first support part and an adjacent second support part configured to collectively support the print head, and wherein the pair of support parts provides a plurality of mating parts for mating with certain parts of the print head.

9. The device according to claim 8, wherein the print head has three mating parts, and wherein the pair of support parts provides three mating parts for mating with the mating parts of the print head.

10. The device according to claim 8, wherein the mating parts of the print head comprise ball parts, and the mating parts of the pair of support parts comprise a flat surface, a conical recess and a vee-groove recess.

11. The device according to claim 1, wherein the primary abutting part and the secondary abutting part are configured to be attached to each other.

12. The device according to claim 1, wherein the sub-unit is configured to hold an array of print heads.

13. The device according to claim 1, wherein the main unit is configured to accommodate an array of sub-units.

14. The device according to claim 1, wherein the connecting member comprises a flexible part, and wherein at least an end of said part, connectable to the print head, is movable relative to the sub-frame between a first position and a second position.

15. The device according to claim 1, wherein the connecting member and the urging member are integrated to form a single part.

* * * * *